United States Patent [19]

Burden et al.

[11] 4,145,959

[45] Mar. 27, 1979

[54] CONSTANT SPEED ACTUATOR

[75] Inventors: Harvey W. Burden, Pebble Beach, Calif.; Phillip J. Brashear, deceased, late of Hollister, Calif., by Kathryn Brashear Ballard, surviving spouse

[73] Assignee: Teledyne McCormick Selph, an operating division of Teledyne Industries, Inc., Hollister, Calif.

[21] Appl. No.: 771,240

[22] Filed: Feb. 23, 1977

[51] Int. Cl.[2] ..... F15B 15/22

[52] U.S. Cl. ..... 92/8; 92/143; 137/504

[58] Field of Search ..... 92/8, 143, 9, 12; 91/440, 437; 60/591, 593; 137/501

[56] References Cited

U.S. PATENT DOCUMENTS

| | | | |
|---|---|---|---|
| 2,679,827 | 6/1954 | Perdue | 92/8 |
| 3,142,230 | 7/1964 | Bidlack | 91/437 |
| 3,336,941 | 8/1967 | English | 137/501 |
| 3,424,154 | 1/1969 | Kinsley | 60/593 |
| 3,425,219 | 2/1969 | Oliver | 60/593 |
| 3,531,065 | 9/1970 | Brown | 92/8 |
| 3,871,527 | 3/1975 | Schimmeyer | 92/8 |
| 4,050,359 | 9/1977 | Mayer | 92/143 |

FOREIGN PATENT DOCUMENTS

| | | | |
|---|---|---|---|
| 2017007 | 10/1971 | Fed. Rep. of Germany | 60/593 |

*Primary Examiner*—Martin P. Schwadron
*Assistant Examiner*—Abraham Hershkovitz
*Attorney, Agent, or Firm*—David H. Semmes; Warren E. Olsen

[57] ABSTRACT

A constant speed actuator significantly characterized by being able to produce a displacement at constant speed, even though the loading on a hydraulically damped piston is substantially varied. The actuator consists of a pneumatic driving pressure which acts against a volume of hydraulic fluid, through a interface with a free piston. The hydraulic fluid, thus acted upon by the pneumatic pressure, flows to the opposite side of the hydraulic load piston through a hydraulic fluid by-pass at a constant volumetric rate regardless of the loading on the hydraulic piston. The constant volume by-pass flow is automatically controlled by employing a constant volume valve in the by-pass. Consequently, a consistent, predictable speed of actuation is achieved over a wide range of hydraulic piston loadings and pneumatic supply pressure.

4 Claims, 5 Drawing Figures

CONSTANT SPEED ACTUATOR

BACKGROUND OF THE INVENTION

1. Field of the Invention

The invention relates to a pneumatically actuated and hydraulically controlled apparatus for moving a loaded actuator piston at a constant speed, regardless of the magnitude and direction of the actuator piston loading. This synergistic result is achieved by employing a particular form of by-pass valve which automatically ensures a constant volumetric flow rate regardless of the pressure of the by-passing hydraulic fluid or pneumatic pressure variations.

2. Description of the Prior Art

Various and sundry prior art actuators have employed fixed or adjustable valvings for regulating the pressure drop in a hydraulic by-pass circuit. While a constant pressure drop valve will ensure a given volumetric flow rate for any fixed inlet pressure, variations in line pressures result in varying volumetric flow rates.

Exemplary of prior art actuators are the United States patents, as follows:

| | |
|---|---|
| KONDO | 3,929,057 |
| SCHIMMEYER | 3,871,527 |
| ROSAEN | 3,858,485 |
| POLIZZI | 3,850,078 |
| McLELLAND | 3,824,900 |
| ALEXANDER | 3,807,284 |
| HALLER | 3,687,013 |
| HUTTER | 3,302,533 |
| SCHOLIN | 3,190,077 |
| ERICSON | 2,587,449 |

The patent to Kondo illustrates a hydraulic brake mechanism which includes a regulating valve to control the flow of hydraulic fluids, for the disclosed purpose of adjusting the speed of the air cylinder piston. Unlike the present disclosure, Kondo employs a needle valve 41 to adjust the rate of actuation speed, and is not directed to a constant actuation speed, regardless of loading.

Schimmeyer employs a regulating valve 75, for allowing an hydraulic override through port 51. As such, Schimmeyer is concerned with maintaining a constant pressure loading and not with a constant speed of actuation for widely varying loads.

The patents to Rosaen and Polizzi both represent additional variable speed hydraulic actuators, and not a combination which purposes are to ensure a constant speed, in response to widely varying loadings. Rosaen employs flow valves 164 and 182 for manually controlling a two-way actuation, at variable speeds. Polizzi employs a hydraulic timer which is controlled by a needle valve 35, for an adjustment of speed response to varying loads.

The patents to McLelland and Alexander both further illustrate variable speed actuators, where the acceleration of the actuator is varied. For this purpose, McLelland supplies air to piston 11 with oil flow controlled by variable bypass valve 64. Again, there is no contemplation of employing a constant volume flow rate to maintain a constant speed. Similarly, Alexander teaches a hydraulic cylinder 24, with hydraulic flow being controlled through passage 106, by needle valve 126. Alexander further employs a stop collar 140 to change the speed of actuation at varying stroke positions, in complete distinction to the purposes of the present invention.

The patent to Haller illustrates a pneumatic-hydraulic actuator employing valve structure formed around a common shaft. Haller, significantly, includes an interchangeable contour part, 40, to control oil flow through orifice 52. Again, Haller is concerned with a variable speed actuator, in complete distinction to the present disclosure.

The patent to Hutter includes a control cartridge 23, for the purpose of metering oil from chamber 50 into reservoir 49, while the present disclosure allows for constant speed over widely varying loads. The patent to Hutter particularly teaches changing the control cartridges 23 when different design loads are to be encountered.

The actuator taught in the patent to Scholin employs an adjustable needle valve 59 for controlling fluid flow between spaces **36*b* and 37*b*. The adjustable needle valve 59 of Scholin is particularly taught for changing the pressure of hydraulic fluid within passage 56**, and is without any disclosed purpose or ability to maintain a constant hydraulic piston actuation speed in response to widely varying loadings.

Finally, Ericson teaches a structurally unrelated form of hydraulic actuator, wherein regulating valves 110 and 115 are used to control overpressures during a feeding operation. Ericson's device senses the pressure on a milling cutter, and consequently change the speed of work feed. Again, there is no purpose in Peterson for a constant volumetric flow rate valve, to control the by-passing of hydraulic fluid on either side of a hydraulic load piston, regardless of the variation of piston loading.

In summary, there has not been found any teaching in the prior art which recognizes the employment of a constant flow control valve in combination with a hydraulic load piston, as specifically taught in the combination presented herein. Significantly, the present combination includes a pneumatic actuation chamber, for applying actuation pressure against one volume of hydraulic fluid through a free piston, to allow for constant actuation of the hydraulic load piston whenever the pneumatic pressure exceeds a minimum threshold value.

SUMMARY OF THE INVENTION

The present invention is a form of pneumatically driven actuator, wherein the speed of actuation is damped by a constant volume of hydraulic fluid. The present invention is defined by a circular cylindrical housing of constant diameter which includes a differential-type load piston having a load shaft extending through one end wall. At the other end of the cylindrical housing there is a pneumatic pressure inlet, wherein pneumatic pressure is allowed to enter through the opposite end of the cylinder to act upon a drive piston comprised by a free piston. The free piston defines two chambers; a pneumatic or gas actuation chamber between its one surface and the gas inlet in a first end wall, and a hydraulic working chamber defined between the other surface of the free piston and an opposed face on the working or load piston which is connected to the load shaft, at its inward end. Through the opposite or second end wall, there is a centrally disposed opening for the extending load shafts, appropriately sealed against fluid leakage. In the annular space between the second end wall and the exposed surface of the load piston an annular hydraulic damping chamber is defined.

The present invention is significantly characterized in the provision of a constant volumetric rate flow passage between the thusly defined hydraulic working chamber and the thusly defined hydraulic damping chamber. Unlike prior art devices which allow for a variable damping fluid exchange between opposite sides of a differential piston, as noted above, the present invention employs a non-adjustable form of flow control valve that automatically bypasses a given volume of fluid, per unit time.

An exemplary form of such a constant volume flow rate control valve is the model 190—2—5.0, which is available from Waterman Hydraulics Components, 6586 W. Howard Street, Niles, Ill., 60648. This preferred form of flow control valve maintains a constant volume flow rate with an extremely wide range of inlet and outlet pressures. Consequently, the present combination has as a primary object the provision of an actuator which is pneumatically driven, and hydraulically controlled, to ensure a constant time duration for the working stroke. The present invention is therefore concerned with applications where the time required for a particular stroke is constant, regardless of the loading imposed upon the actuator shaft. Unlike prior art devices, as discussed above, the present invention achieves a constant stroke time, and does so without requiring any attention on the part of the operator, or other form of external adjustments for compensation of variable loadings on the actuator shaft.

It is a further significant object of the present invention to provide for a constant speed of actuation regardless of a negative or positive loading upon the load shaft.

It is a further object of the present invention to provide for a structure which will make the load of actuation a simple function of a threshold pneumatic supply pressure, while maintaining a constant speed of actuation for the desired actuation stroke, despite pneumatic pressures above the threshold.

Other features, advantages and objects of the present invention may be understood by reference to the following detailed description of two embodiments, wherein reference is made to the attached drawings.

DESCRIPTION OF THE PREFERRED EMBODIMENTS

Figure 1:
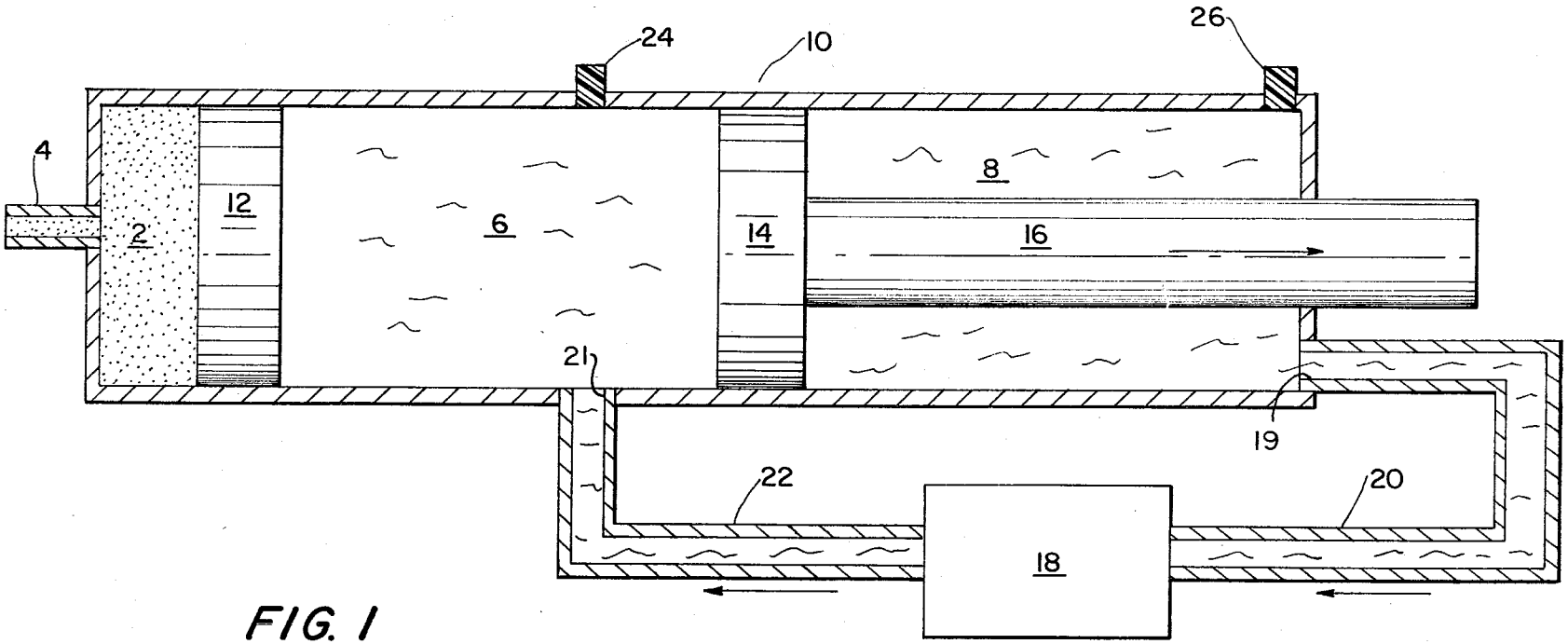
FIG. 1 is a schematic representation of the essential operating elements of the present invention.

The basic components of a pneumatically powered and hydraulically controlled actuator according to the present invention are schematically illustrated in FIG. 1. The present invention allows for a constant speed of actuation within design limits of driving pressure and load, as will be hereinafter more particularly pointed out. A cylindrical housing 10 comprises a constant diameter cylinder having a first end wall and a second end wall, respectively closing each end of the cylinder. At the first end wall a pneumatic pressure supply port 4 is provided for filling one end of the actuator cylinder with a high pressure gas for actuation purposes. The pneumatic pressure supply port 4 may be connected to any source of high pressure gas, and the source of supply is not further illustrated.

A centrally disposed load shaft 16 extends through the second end wall and inwardly into the cylinder 10. At the innermost extension of the centrally disposed load shaft 16 a load piston 14 is secured. The load shaft 16 is sealingly engaged as it passes through the second end wall, and the periphery of the load piston 14 is similarly sealed within the cylindrical cylinder 10. As will be appreciated from considering the structure of FIG. 1, there is further provided a floating drive piston element at 12, with this free or drive piston also being sealingly engaged within the constant diameter cylindrical housing 10. Because the load piston 14 is sealingly engaged for longitudinal travel within the cylinder 10, there is defined an annular damping chamber between the rear face of the load piston 14 and the inner surface of the second end wall. In like fashion, the free piston 12 remains sealingly engaged at various longitudinal positions of travel within the cylinder, and is spaced from the first end wall to define a gas actuation chamber. Between the opposite face of the free piston, and the opposing face of the load piston 14, there is defined a fluid chamber, which is defined for purposes of this application as a hydraulic working chamber. The hydraulic working chamber 6 is interconnected with the hydraulic damping chamber 8 through a series of passages, which will be hereinafter more particularly described. A first hydraulic passage 19 communicates the hydraulic damping chamber with a constant volume flow rate control valve 18, while a second hydraulic passage 21 connects the hydraulic working chamber 6 with a second port of the constant volume flow rate control valve 18. In the schematic illustration of FIG. 1, the fluid communication between the respective hydraulic passages is accomplished by a first hydraulic line means 20, which extends externally of the cylinder 10 to terminate at a first port of the bypass valve 18. In like fashion there is illustrated a second hydraulic line means 22 which extends from the second hydraulic passage 21 to connect with a second port of a control valve 18. In order to ensure that both hydraulic working chambers, the first and second hydraulic line means, and the bypass valve are filled with, and define a closed volume of hydraulic fluid, there is provided purging arrangement for each respective hydraulic chamber. The vent plug 24 allows an initial venting of the volume within the hydraulic working chamber, and the vent plug 26 similarly allows for a venting of any entrained air from the hydraulic damping chamber 8. In operation, it is essential that the present invention define a closed volume of hydraulic fluid between the respective hydraulic chambers, and the vent plugs are provided to allow for initial venting of any air to achieve this closed volume of hydraulic fluid.

Clearly, the free piston 12 functions to separate actuation gas in chamber 2 from hydraulic liquids contained within the hydraulic working chamber 6. The free piston 12 is of a constant diameter within the constant diameter housing 10, thereby ensuring that there will be an equality of pressure exerted upon the hydraulic working chamber 6 by the gas pressure within the gas actuation chamber 2. The combination of the load piston 14 and the load shaft 16 functions to define a differential in working areas on each side of the load piston 14. As shown in FIG. 1, when gas actuation pressure is supplied to the free piston 12, by an external supply through the gas inlet port, the fluid within hydraulic working chamber 6 will function to exert a differential force upon the centrally disposed load shaft 16. The stroke limits of the actuator as shown in FIG. 1 are determined by the requirement that the drive piston 12 remain to the left of the illustrated second hydraulic passage 21, while the load piston 14 must be limited to travel between the first hydraulic passage 19 and the second hydraulic passage 21.

Having now described the basic functional elements, as schematically illustrated in FIG. 1, the functioning of the actuator will be now hereinafter further explained by parametric analysis, and actual test results.

A primary supply gas is introduced under pressure to chamber 2. The drive piston ensures separation of the gas in chamber 2 and the liquid in chamber 6, while compressing the liquid to a pressure equal to that of the gas, less any static and dynamic friction effects due to fluid and piston movement. The pressure applied to the left side of the load piston 14 produces a force on the load piston and shaft to the right. The differentiated force causes the load (piston and shaft and any attached load) to move to the right, slightly. Any such movement is resisted by friction between the load piston 14 and the cylinder, the load shaft 16 and the cylinder end wall, fluid friction, the load itself, and the pressure of the liquid in damping chamber 8 acting upon the right side of load piston 14. Neglecting friction, and with no attached load, any pressure in chamber 6 will move the load piston to the right, compressing the liquid in chamber 8. If there were no connection between chambers 6 and 8, the pressure in chamber 8 would increase to where the force on the right face of the load piston, and an integration of atmospheric pressure upon the end area of the load shaft, equals that integrated pressure force on the left face of piston 14. Since the vertical piston area on which the liquid in chamber 8 can act is less than that in chamber 6, and the opposing forces must be equal, pressure in chamber 8 must be greater than that in chamber 6.

Figure 2:
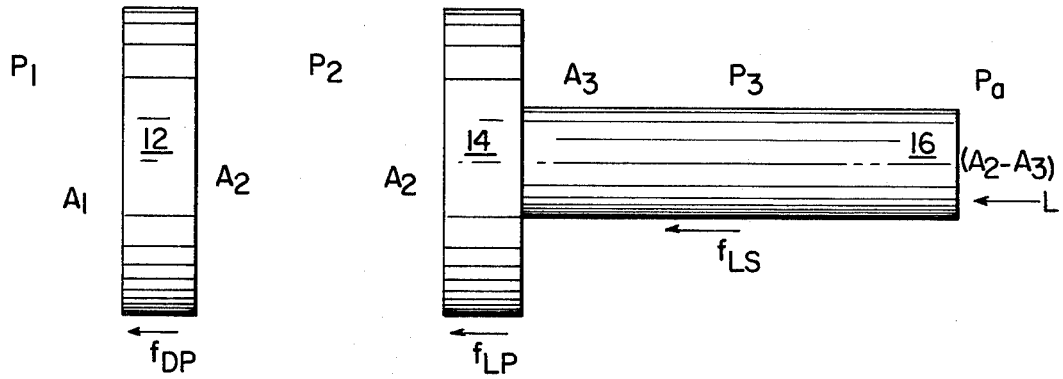

Using the nomenclature illustrated in FIG. 2, the governing differential force equation for a constant speed of actuation, i.e., all forces balanced creating no net longitudinal acceleration, is, as follows:

$$\Sigma F = p_2A_2 - p_3A_3 - p_a(A_2 - A_3) = 0$$

$$p_3/p_2 = (A_2/A_3)(1 - p_a/p_2) + p_a/p_2$$

where pressures are absolute. If $p_a << p_2$, $p_3/p_2 = A_2/A_3$.

With an unrestricted passage, between chambers 6 and 8, fluid would flow from 8 to 6 and the gage pressures would be equal, after some initial unsteady inertial effects. The differential load piston areas would thus produce a net force to the right, and the load shaft would accelerate to the right. In the present invention, the flow control valve in the channel between chambers 6 and 8 fixes the liquid volume flow rate as the liquid is forced from chamber 8 into chamber 6 by the higher pressure in chamber 8. Since hydraulic fluid is very nearly incompressible, the constant volume flow rate of liquid leaving chamber 8 ensures that the load must travel at a constant speed.

Figure 3:
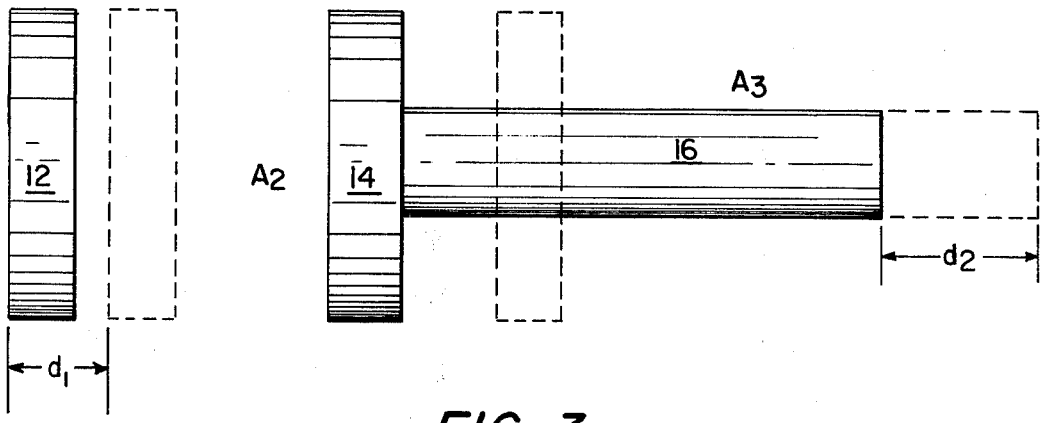
FIGS. 2 and 3 are schematic representations of the parameters upon which the present invention is taught to function.

FIG. 3 further illustrates the governing relationship between the geometry of the device and relative displacements of the primary moving elements.

Due to the closed hydraulic circuitry taught herein, volume of liquid displaced from chamber 8 must equal that accepted in chamber 6. Hence:

$$A_2(d_2 - d_1) = A_3d_2$$

$$d_1 = d_2(1 - A_3/A_2)$$

This expression for the drive piston travel, $d_1$, is useful to determine the length of cylinder required for chamber 6 when the device is unactuated (chamber 2 at minimum volume). The maximum value of $d_2$ is the design stroke of the actuator.

The flow control valve 18 will maintain a constant volume flow rate of liquid so long as the pressure drop across it is within specified limits. Conversely, there is a variable pressure drop created across the valve while it is maintaining constant volume flow rate, the value of which is determined by forces driving the liquid flow. With a pressure drop below the lower limit, volume flow rate will be less than the specified "constant" value; with a pressure higher than the upper limit, volume flow rate may exceed the "constant" value. With steady state, unaccelerated motion of the load, there is, horizontally, a balance of forces, resulting in no net acceleration of the load shaft 16, in FIG. 1.

On the drive piston 12, horizontally, with absolute pressures, $$\Sigma F = p_1A_1 - f_{DP} - p_2A_2 = 0$$

$$p_2 = p_1 - f_{DP}/A_2$$

since $A_1 = A_2 \cdot f_{DP}$ is the friction force between the drive piston and the cylinder. On the load piston/shaft, horizontally, $$\Sigma F = p_2A_2 - f_{LP} - p_3A_3 - f_{LS} - L - p_a(A_2 - A_3) = 0$$

where $f_{LP}$ and $f_{LS}$ are friction on the load piston and load shaft and Pa is atmospheric pressure. With the liquid flowing through the flow control valve, $$p_3 = p_2 + \Delta p + \Delta p_{FF}$$

where $\Delta p$ is the pressure drop across the flow control valve and $\Delta p_{FF}$ is the drop due to fluid flow friction in the connecting passage. Thus, we have $$L = p_1A_2 - f_{DP} - f_{LP} - (p_2 + \Delta p + \Delta p_{FF})A_3 - f_{LS} - p_a(A_2 - A_3)$$

$$= p_1A_2 - f_{DP} - f_{LP} - (p_1 - f_{DP}/A_2 + \Delta p + \Delta p_{FF})A_3 - f_{LS} - p_a(A_2 - A_3)$$

$$L = (p_1 - p_1)(A_2 - A_3) - \Delta pA_3 - f$$

where $f = f_{DP}(1 - A_3/A_2) + f_{LP} + f_{LS} + \Delta p_{FF}A_3$ represents the summed effect of friction between the moving pistons, the shaft and the cylinder and that in the connecting fluid passage.

It should be noted, then, that the load, L, that can be driven by the device is a function of the geometry, $A_2$ and $A_3$, the supplied gas pressure, $p_1$, the pressure drop across the flow control valve, $\Delta p$, and the combined effects of friction, f. This is the steady state situation. At each limit of the stroke, when solid components and fluids are being accelerated, the inertial reactions of both solid and fluid components will modify the above equations. Any variations in load or supply pressure will cause transients. The visco-elastic behavior of the fluids involved — primarily the supply gas and, much less, the liquid hydraulic fluid — and, to an insignificant extent, of the solid components will allow an oscillatory, hopefully damped, transient response to both the start-up impulse and supply/load variations. A rapid decrease in the volume of damping chamber 8, at the end of the stroke, provides a buffering action due to restriction of liquid entering the first hydraulic passage 19.

As will be shown by example, hereinafter, unsteady transients, at the beginning and end of the actuator stroke, are not significant according to the disclosed structure.

EXAMPLE

Figure 4:
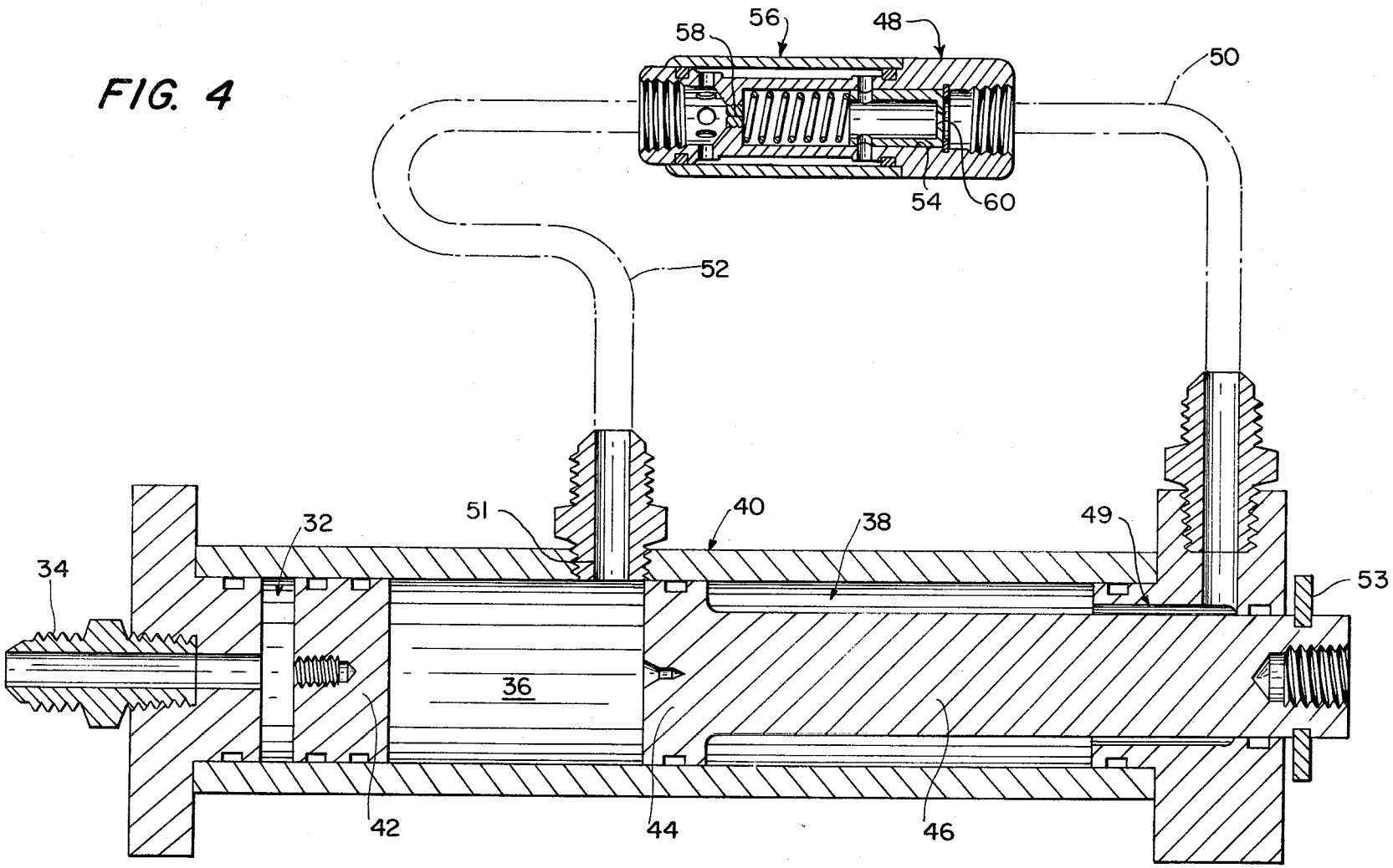
FIG. 4 is a sectional plan representation of a preferred embodiment according to the present invention.

The basic operating equation for this constant speed actuator was previously derived and can be restated as $$L = p_s A_{LS} - \Delta p(A_{DC} - A_{LS}) - f$$

where:

L ~ driven load, lb
$p_2$ ~ supplied gas pressure, psig
$\Delta p$ ~ flow control valve pressure drop, psi
$A_{LS}$ ~ load shaft cross-section area, $in^2$
$A_{DC}$ ~ drive cylinder cross-section area, $in^2$
f ~ composite friction effect, lb The actuator configuration for this example is the preferred embodiment, as shown in FIG. 4.

$$A_{LS} = \pi\,(1.00)^2/4 = 0.785\ in^2$$

$$A_{DC} = \pi\,(1.50)^2/4 = 1.767\ in^2$$

$$\Delta p = 70\ psi\ to\ 3000\ psi$$

The preferred embodiment of FIG. 4 includes a cylindrical housing 40, of constant cross-section, with a drive piston 42 having a pair of annular seals disposed about its periphery. A gas or pneumatic pressure inlet 34 is disposed centrally in the first end wall of the cylinder 40. The load shaft 46 is centrally and sealingly disposed within the second end wall, with an annular stop 53 to define a stroke of 3.0 inches. The hydraulic damping chamber 38 communicates through an annular first hydraulic passage 49 to an externally mounted first hydraulic line means, 50. In like fashion, the hydraulic working chamber 36 communicates through a second hydraulic passage, 51, in the wall of housing, 40, with a second hydraulic line means 52.

The flow control valve, 48, for this example was a model 190—2—5.0 from Waterman Hydraulics Components, 6585 W. Howard Street, Niles, Ill., 60648. Within the pressure drop range specified, (70–3000 psi), it maintains flow rate at 5.0 ± 0.5 gal/min. There is also a model 1908—2—5, 5.0 ± 0.5 gal/min at 70–5000 psi, available. The actuator geometry and flow control valve characteristics as given above produce a nominal stroke time of 150 milliseconds for the embodiment of FIG. 4.

Further operating details of the constant volumetric flow rate control valve 48 may be had by available product literature from Waterman Hydraulics Components, and such details are incorporated herein by reference.

The maximum pressure drop specified for the flow control valve 48 to maintain constant flow corresponds to the minimum load for constant actuation speed. Inserting the given values into the load equation produces $$L = 0.785\,p_s - 0.982\,(3000) - f$$

With a supply gas pressure of 1000 psig at gas inlet 34, into actuator chamber 32, and no friction (f = 0 lb), the minimum load is −2161 lb, or a pull of 2161 lb. upon the end of the actuator shaft, 46, in FIG. 4.

Conversely, the minimum pressure drop specified for constant flow corresponds to the maximum load for constant speed. This gives $$L = 0.785\,p_s - 0.982\,(70) - f$$

With 1000 psig supply gas pressure and no friction, this is 716 lb, or a push of 716 lb, on the end of the actuator shaft, 46, in FIG. 4.

In each of the above cases, any system friction will decrease the load value computed. A series of minimum and maximum loads which will be driven at constant speed will result from a series of supply gas pressures and a given value or values of internal friction. The no friction case is presented in Table I.

TABLE 1

CONSTANT SPEED LOADS (NO FRICTION)

| $p_s$ (psig) | $L_{min}$ (lb) | $L_{max}$ (lb) |
|---|---|---|
| 0 | -2946 | -69 |
| 88 | -2877 | 0 |
| 100 | -2868 | 10 |
| 500 | -2554 | 324 |
| 1000 | -2161 | 716 |
| 2000 | -1376 | 1501 |
| 3753 | 0 | 2877 |
| 5000 | 979 | 3856 |

A supply pressure less than 87.6 psig will produce constant speed of actuation only at loads of less than zero, or pulls upon the end shaft of shaft 46. At loads less than $L_{min}$ the 3000 psi limit on the flow control valve will be exceeded. At loads greater than $L_{max}$ the 70 psi limit is exceeded and speed of actuation is decreased. 87.6 psig is the lowest supply pressure at which no load, constant speed actuation can take place with no friction.

For a supply pressure greater than 3753 psig, the no load, no friction situation demands a pressure drop across the flow control valve in excess of 3000 psi and structural failure could result. The maximum load which can be driven at constant speed, however, is increased above that for lower supply pressures.

Therefore, as is apparent from TABLE 1, a supply pressure of about 1920 psig will drive a balanced push-pull range of loads at constant speed.

The test set-up used to verify TABLE 1 is illustrated, as follows:

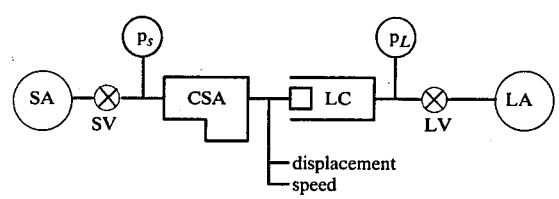

The supply accumulator, SA, was charged with supply gas under pressure. When the solenoid operated valve, SV, opened, supply pressure $p_s$, was applied to the constant speed actuator, CSA. Supply pressure was recorded as a function of time, as were actuator displacement and speed. Load could be applied to the actuator by means of a piston-cylinder (of 2.5 inch inside diameter) load cell, LC, and a load accumulator (of 750 cubic inch volume), LA, arrangement. Pressure within the load cell, $p_L$, was recorded as a function of time. The load cell could be either vented to atmosphere or completely disconnected from the actuator for no load tests. With the load valve, LV, open, the load cylinder and load accumulator volumes insured a nearly constant load pressure, thus a nearly constant load. With the load valve closed, the compression ratio of the load cell provided an increasing load of about a 3:1 ratio. The load cell and/or load accumulator could be pressurized to any desired value before a run to provide appropriate loads on the accumulator.

A spacer 53 was placed around the load shaft 46, external to the actuator housing 40, to prevent the load piston 44 from stroking more than three inches. Nitrogen was the supply gas and was also used to pressurize the load cell/accumulator as needed. Hydraulic fluid used in the actuator was AEROSHELL 4, MIL-H-5606A.

Internal friction was found to be present during the testing. In order to determine the value of this friction, supply pressure was slowly increased from zero with the load cell completely vented and also with the load cell disconnected. The range of values of supply pressure needed to move the actuator piston gave a corresponding range of values of internal friction through the load equation with load, L, and $\Delta p$ equal to zero, or $$f = 0.785\ p_s$$

Since internal friction was a significant factor at lower supply pressures and/or higher load values, a series of special runs was made to determine the internal friction. This was accomplished by operating the actuator under no load at a series of supply pressures increasing in small steps from zero. Steps of approximately 5 psi were used. Movement of the actuator shaft of about one-half to one inch was produced by about 40 psig. A supply pressure within the range of 80 to 160 psig was required over several runs to produce a full three inch actuator stroke. In all cases, the stroke was very slow. This 80 to 160 psig pressure range corresponds to a range of friction of 63 to 126 pounds. The friction value of 126 pounds was used in subsequent actuator performance calculations. Since this value was the maximum obtained after all the operational tests, there is uncertainty as to when friction was building up and to what values during the earlier tests. Preoperational actuation of the device showed an internal friction of less than about 25 pounds.

Modification of TABLE I values to account for internal friction (126 pounds) results in the values of TABLE II.

Table II

| CONSTANT SPEED LOADS (WITH FRICTION) | | |
|---|---|---|
| $p_s$ (psig) | $L_{min}$ (lb) | $L_{max}$ (lb) |
| 0 | -3072 | -195 |
| 88 | -2998 | -126 |
| 100 | -2994 | -116 |
| 248 | -2877 | 0 |
| 500 | -2680 | 198 |
| 1000 | -2287 | 590 |
| 2000 | -1502 | 1375 |
| 3753 | -126 | 2751 |
| 3913 | 0 | 2877 |
| 5000 | 853 | 3730 |

Hence, new supply pressures for zero minimum and maximum loads at design actuation speed are generated. All other load values are reduced by 126 pounds of friction. The results of all the test runs are listed in TABLE III. The design maximum loads which allow constant speed with friction are shown with the maximum load experienced on each run.

Table III

| TEST RESULTS | | | |
|---|---|---|---|
| Run | $p_s$ (psig) | Time (ms) | Max. Load, Act/Des (lb) |
| 1 | 1000 | 150 | 0/590 |
| 2 | 1000 | 155 | 221/590 |
| 3 | 1000 | 150 | 221/590 |
| 4 | 1000 | (140) | 343/590 |
| 5 | 1000 | 170 | 441/590 |
| 6 | 1000 | — | 745/590 |
| 7 | 1000 | 155 | 88/590 |
| 8 | 1000 | 150 | 490/590 |
| 9 | 1000 | 150 | 686/(700) |
| 10 | 1000 | — | 735/590 |
| 11 | 1000 | — | 735/590 |
| 12 | 1000 | — | 711/590 |
| 13 | 120 | 200 | 0/-101 |
| 14 | 120 | 350 | 0/-101 |
| 15 | 140 | 190 | 0/-85 |
| 16 | 220 | 150 | 0/-22 |
| 17 | 470 | 150 | 0/174 |
| 18 | 820 | 155 | 0/449 |
| 19 | 1100 | 150 | 0/669 |
| 20 | 1550 | 150 | 0/1022 |

In judging the actuator performance as listed in TABLE III with respect to the load schedule of TABLE II, it is seen that the design goal has been achieved. The binding due to test rig shifting and internal scoring and friction were errors in test techniques and not in the device itself.

TABLE II gives the design load range for 1000 psig supply as −2287 to 590 pounds. In TABLE III, Runs 1–4 show that the actuator stroked as designed, except for one bind. At Run 5, the stated load of 441 pounds was less than the design limit of 590 pounds. The slightly increased action time of 170 milliseconds indicates that the actual load was slightly in excess of the upper design limit; thus, the speed was reduced. This reduced speed was constant, however, as expected. In Runs 7 and 8 the action times were near design (150 milliseconds) and the loads were within limits either without or with friction (TABLE I or TABLE II). The Run 9 action time of 150 milliseconds indicates that friction probably was not the full 126 pounds during that run. Since this was one of the earlier tests of the series, this was likely the case. Runs 10 and 11 involved shaft binding due to an error in test set-up. In 12, high internal friction (higher than 126 pounds) was apparently involved, in addition to shaft binding. The runs 13, 14 and 15 were against loads in excess of the design upper limit and action times were increased. The runs 16–20 were against loads near to or less than the design maximum and action times were very close to nominal. Since the flow control valve was specified to control volume flow at 5.0 ± 0.5 gallons/minute, the design action time is actually 150 ± 15 milliseconds.

The observed high frequency oscillation trace from the speed transducer was most probably due to transducer/mounting characteristics. The lower frequency speed transient during initial parts of the stroke were probably in the actuator itself since the speeds and accelerations match the displacement trace slopes and rates of change of slope. Transients near the end of the stroke also correlate on the two transducers.

The high frequency oscillation in the supply gas pressure was at about 300–400 Hz everywhere it occurred. Since the frequency is above that of the actuator piston/shaft (about 50–70 Hz), then an oscillation of such frequency in the supply gas could not excite the lower frequency oscillation in the actuator. Study of where the supply pressure oscillation occurred implies that it was either a gas flow phenomenon within the gas supply line/supply valve or flow induced oscillations of the pressure transducer itself.

The 50–70 Hz mechanical oscillation of the actuator was rather lightly to moderately damped. However, the damping seems from crude measurements to be about 10% of critical damping (i.e. 10% of the least damping required for an excursion to return to steady state without overshooting, or oscillation).

In the preferred embodiment of FIG. 4, the constant volumetric flow rate control valve 48 is shown mounted externally to the actuator cylinder, 40. The flow control valve 48 will maintain a constant volumetric flow rate upon flows from the first hydraulic line, 50, as will occur during the operation of this device. In the non-working return stroke, when the load shaft 46 is being moved leftwardly, as shown in FIG. 4, hydraulic fluid will freely return from hydraulic working chamber 36, through the second hydraulic line, 52, and ultimately into the hydraulic damping chamber 38. The valve 48 may further be described to have a movable member 54, which is resiliently movable upon hydraulic pressure supplied through first hydraulic line 50. A pyramidal orifice, 60, is located in the rightmost face of the movable member, 54, and the illustrated model, as available from Waterman Hydraulics Components, herein before discussed, includes a very small bleed orifice 58, located in the body of the valve. The pyramidal orifice 60 has a smallest dimension which is on the order of 0.030 inches, and the bleed orifice 58 is on the order of 0.008 inches, to act as a pressure relief if excessive hydraulic pressure from line 50 moves the ports on movable member 54 completely beyond registration with the associated ports in the main body of the valve, 48. The valve body also includes a cover 56, simply to allow passage of a constant volume of hydraulic fluid, past the movable member 54 and into the second hydraulic line 52.

Figure 5:
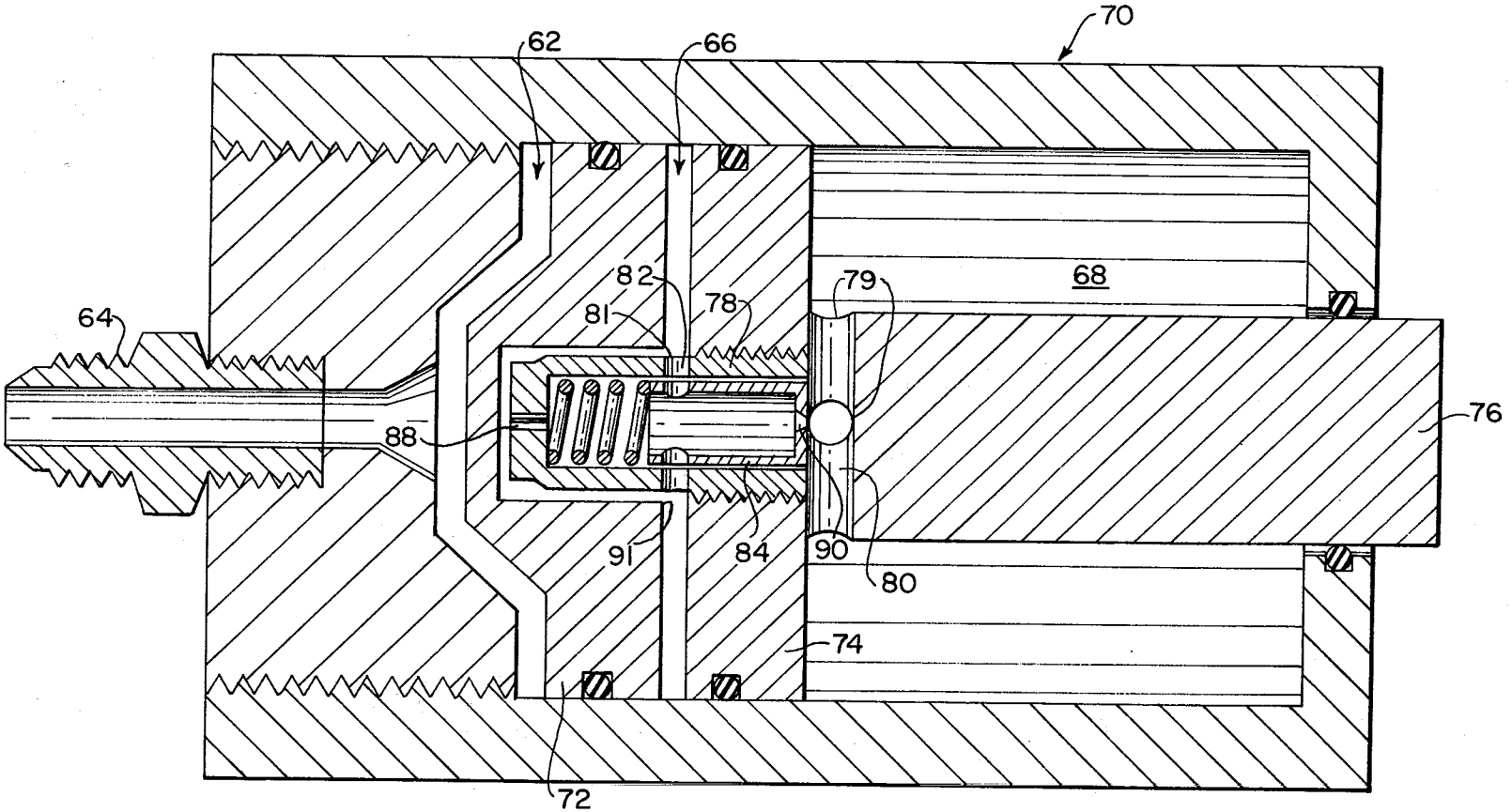
FIG. 5 is a sectional plan of a second embodiment.

A second embodiment of the invention is shown in FIG. 5, wherein the flow control valve has been internally mounted, in distinction to the external mounting of a flow control valve, 48, in FIG. 4. The second embodiment of FIG. 5 functions in a manner identical to the preferred embodiment of FIG. 4, while allowing a more compact arrangement of structure.

The embodiment of FIG. 5 includes a cylindrical housing 70, of constant cross section, with a drive piston 72 having a pair of annular seals disposed about its periphery. A gas or pneumatic pressure inlet 64 is disposed centrally in the first end wall of cylinder 70. The load shaft 76 is centrally and sealingly disposed within the second end wall. In the embodiment of FIG. 5 the internal geometry of the components allows for a stroke definition for load shaft 76 without the necessity of an external annular stop on the load shaft 76, though one may be optionally employed to selectively define the beginning of the acuation stroke, as desired. The hydraulic damping chamber 68 communicates through a plurality of circular passages, 79, to an integrally formed series of first hydraulic line means, 80, formed within the load shaft 76. The hydraulic working chamber 66 communicates through a second hydraulic passage, 81, defined by at least one orifice formed in the body of the integrally mounted flow control valve, generally indicated at 78. The second hydraulic passage 81 is preferrably a plurality of radial orifices, connected to the valve 78 through a corresponding plurality of second hydraulic line means, 82.

The flow control valve, 78, in this example, was also a model 190—2—5.0, as hereinbefore discussed with respect to the embodiment of FIG. 4, though modified for an integral mounting within the load piston 74. The flow control valve includes a male thread, on 78, for mating engagement within a female thread formed directly into the load piston, 74. The movable member 84 also includes a pyramidal orifice 90, and the movable member 84 is limited in its rightward travel by abutting against the inner terminus of the radially disposed first hydraulic line means 80.

In the second embodiment, of FIG. 5, the drive piston 72 has been modified to allow the hydraulic chamber 66 to be minimized when the load shaft 76 is at the beginning of its actuation stroke, approximate the position shown in FIG. 5. Of course, the relieved configuration of the drive piston, 72, in FIG. 5, does not affect its ability to transmit the pressure of actuation gas in 62 directly to the fluid in the hydraulic working chamber 66, insofar as the respective left and right areas of the drive piston 72 have the same area, when projected on a vertical plane. The constant volumetric flow rate control valve 78 in FIG. 5 differs structurally from the flow control valve 48, in FIG. 4, in that only insofar as a separate external second hydraulic line means has been incorporated into the body housing, at 82. The second hydraulic passage 81 is directly proximate the hydraulic fluid in the working chamber 66, as is the bleed orifice 88, as illustrated in FIG. 5. The working stroke of the embodiment of FIG. 5 may begin when the hydraulic fluid in working chamber 66 is at a minimum, proximate the piston of load shaft 76 as shown. The appropriate minimum of the hydraulic working fluid volume 66 may be controlled by a valving of the second hydraulic passage 81 as it moves leftward, passed the shoulder 91 on drive piston 72. Alternatively, an external annular stop may be secured around the load shaft 76, in a manner analogous to the annular stop 53, as shown in the embodiment of FIG. 4.

The embodiment of FIG. 5 is advantegeous for its incorporation of the constant volumetric flow rate valve 78 within the actuator cylinder 70, thus avoiding the necessity of first and second hydraulic passages formed within the cylindrical walls of the actuator cylinder.

While two embodiments of our invention have been shown and described, the invention is not limited thereto, but is defined solely by the scope of the appended claims.

We claim:

1. A fluid actuated and hydraulically damped actuator for ensuring a constant speed of actuation over the working length of a load piston, regardless of external piston loading or fluid supply pressure, comprising, in combination:

(A) a cylindrical housing comprising a constant diameter cylinder having a first end wall and a second end wall, respectively closing each end of said cylinder, with a fluid pressure supply port at said first end wall; and (B) a centrally disposed load shaft extending through said second end wall and inwardly into said cylinder, a load piston secured onto the inward extension of said load shaft to thereby define a hydraulic damping chamber in an annular space between said second end wall and said load piston, said load piston being sealingly engaged for longitudinal travel within said cylinder; and (C) a drive piston, comprising a free piston sealingly engaged for longitudinal travel within said cylinder, and spaced from said first end wall to define an actuation chamber, and spaced from said load piston to define a hydraulic working chamber; and (D) a first hydraulic passage, communicating with said hydraulic damping chamber and a second hydraulic passage communicating with said hydraulic working chamber; and (E) a first hydraulic line means fluidly interconnecting said first hydraulic passage, comprising at least one orifice on said load shaft, and a first port of a bypass valve, and a second hydraulic line means fluidly interconnecting said second hydraulic passage and a second port of said bypass valve, wherein said both hydraulic chambers, said first and second hydraulic line means and said bypass valve are filled with, and define, a closed volume of hydraulic fluid, wherein further;

(F) said bypass valve partially extends inwardly from said load piston and is disposed at least partially within the inward extension of said load shaft, and said free piston includes a recess in a first surface thereof which is adapted to accept the extension of said bypass valve when the volume of said hydraulic working chamber approaches a minimum; wherein said bypass valve is operable to automatically allow only a constant volumetric flow rate of fluid to pass between said first and second ports regardless of variable hydraulic pressures in said first and second hydraulic line means whereby speed of actuation of said load shaft will remain substantially constant, whenever fluid pressure supplied to said supply port is equal to, or above, a threshold value.

2. An actuator according to claim 1 further including an annular sealing means between said load shaft and said second end wall.

3. An actuator, according to claim 1, wherein said second hydraulic passage comprises at least one orifice on a body portion of the extension of said bypass valve.

4. An actuator, according to claim 3, wherein the recess on said first surface of said free piston includes a shoulder adapted to cooperate with said second hydraulic passage to define a minimum volume of hydraulic fluid within said hydraulic working chamber, when the first surface on free piston is proximate said load piston.

* * * * *